United States Patent [19]

Matsuda et al.

[11] 4,252,211

[45] Feb. 24, 1981

[54] LOUDSPEAKER

[75] Inventors: Atsushi Matsuda, Tokyo; Jun Kishigami, Urawa, both of Japan

[73] Assignee: Sony Corporation, Tokyo, Japan

[21] Appl. No.: 65,626

[22] Filed: Aug. 10, 1979

[30] Foreign Application Priority Data

Aug. 14, 1978 [JP] Japan ..... 53/98818

[51] Int. Cl.[3] ..... H04R 7/00

[52] U.S. Cl. ..... 181/166; 181/173

[58] Field of Search ..... 181/157, 161, 166, 172, 181/173, 199; 179/115, 5 R, 5 PC, 119 R, 180, 181 R

[56] References Cited

U.S. PATENT DOCUMENTS

| | | | |
|---|---|---|---|
| 2,956,538 | 10/1960 | Rich | 179/180 |
| 3,767,005 | 10/1973 | Bertagni | 181/166 |
| 3,935,400 | 1/1976 | Koga | 179/180 |
| 4,122,314 | 10/1978 | Matsuda et al. | 179/115.5 R |
| 4,191,863 | 3/1980 | Matsuda et al. | 179/115.5 R |

*Primary Examiner*—L. T. Hix
*Assistant Examiner*—Benjamin R. Fuller
*Attorney, Agent, or Firm*—Lewis H. Eslinger; Alvin Sinderbrand

[57] ABSTRACT

A loudspeaker includes a flat plate diaphragm mounted in a speaker frame and which is driven by a plurality of magnetic drivers each having a magnetic gap, a voice coil bobbin connected to the diaphragm at a respective node portion of the divided vibration mode and a voice coil in the respective magnetic gap and being wound around the voice coil bobbin therein. Rotational vibration of the diaphragm is prevented by a pole member which is connected from the center of the diaphragm to a damper supported behind the speaker frame on a damper supporting frame. The leverage due to the longer length of the pole member makes the damper member more effective in resisting rotational vibration. The damper supporting frame is mechanically connected to the speaker frame and/or magnetic drivers to add stiffness to the structure.

17 Claims, 11 Drawing Figures

LOUDSPEAKER

BACKGROUND OF THE INVENTION

This invention generally relates to a loudspeaker, and more particularly to a loudspeaker in which a flat-plate diaphragm is driven by a plurality of magnetic drivers at a plurality of spaced-apart points.

In a flat-plate diaphragm loudspeaker, a flat-plate, usually square, diaphragm is simultaneously driven at a plurality of vibration nodes of the several vibration modes of the flat-plate diaphragm by a plurality of magnetic drivers. Simultaneous drive at vibration nodes tends to raise the frequency at which vibration of the flat-plate diaphragm breaks down into separate vibration nodes. Hence, piston motion of the flat-plate diaphragm is extended to higher frequencies and the frequency response of the loudspeaker is improved.

Voice coil bobbins having voice coils of the magnetic drivers wound thereon are connected at one of their ends to appropriate points on the rear of the flat-plate diaphragm. Dampers are connected to the body of the voice coil bobbins to stabilize the flat-plate diaphragm against all except forward and rearward motion. Since the voice coil bobbins are attached to, and vibrate with, the flat-plate diaphragm, their mass must be kept low. This prevents giving the voice coil bobbins significant strength.

Due to strength limitations in the voice coil bobbins of the magnetic drivers, the dampers are attached to the voice coil bobbins only a short distance to the rear of the flat-plate diaphragm. Due to this short distance, the dampers lack sufficent leverage to fully damp rotational vibration of the flat-plate diaphragm. Thus the flat-plate diaphragm rolls when the loudspeaker is driven. The rotational vibration may be considered as resulting from the combination of driving power of the plurality of magnetic drivers, the stiffness or compliance of the suspension unit including, for example, the damper and the diaphragm edge connection, the weight and balance of the flat-plate diaphragm owing to the distribution of adhesive used for combining the edges, bobbins and dampers and the radiation impedance of reflected acoustic waves returned to the flat-plate diaphragm by floors and walls.

Further, the plurality of magnetic drivers occupy a large proportion of the area in the rear of the diaphragm, and the distance between the flat-plate diaphragm and the magnetic drivers is necessarily smaller than that of a cone type loudspeaker. Therefore, the frame which supports the magnetic drivers requires substantial openings outside the areas occupied by the magnetic drivers. Hence, an equivalent openness ratio at the rear of the speaker, defined as the open area divided by the area of the flat-plate diaphragm, is less than that of a cone-type loudspeaker.

When the equivalent openness ratio at the rear of the diaphragm is less than 60%, the frequency response of the loudspeaker is adversely affected. In fact, the larger the openness ratio, the better the frequency response of the loudspeaker. It is difficult to increase the openness ratio since the openings can only be formed in limited areas of the frame outside the mounting area of the magnetic drivers. Furthermore, when large openings are included for increasing the openness ratio, the stiffness of the frame is reduced. As a result, the frame supporting the relatively heavy magnetic drivers is permitted to resonate with the result that the frequency response and naturalness of the reproduced sound is degraded. Accordingly, flat-plate loudspeakers are normally designed for a compromise between increasing the openness ratio, and obtaining improved frame stiffness.

OBJECTS AND SUMMARY OF THE INVENTION

Accordingly, it is an object of the present invention to provide an improved loudspeaker which avoids the defects in previous flat-plate loudspeakers.

Another object of this invention is to provide a flat-plate loudspeaker which prevents rotational vibration or rolling of the diaphragm.

A further object of this invention is to provide a loudspeaker which prevents resonance vibration of the frame.

A still further object of this invention is to provide a loudspeaker having improved acoustic and frequency response characteristics.

According to an aspect of the invention, there is provided a multi-drive flat-plate loudspeaker comprising a frame, a diaphragm, means for resiliently mounting the diaphragm in the frame, means mounted on the frame for driving the diaphragm at a plurality of points thereon, a pole connected to the diaphragm, means for damping movement of the pole, and supporting means connected to at least one of the frame and the means for driving for supporting the damping means.

The above, and other objects, features and advantages of the present invention will become apparent from the following description read in conjunction with the accompanying drawings in which like reference numerals designate the same elements.

DETAILED DESCRIPTION OF THE PREFERRED EMBODIMENTS

Figure 1:
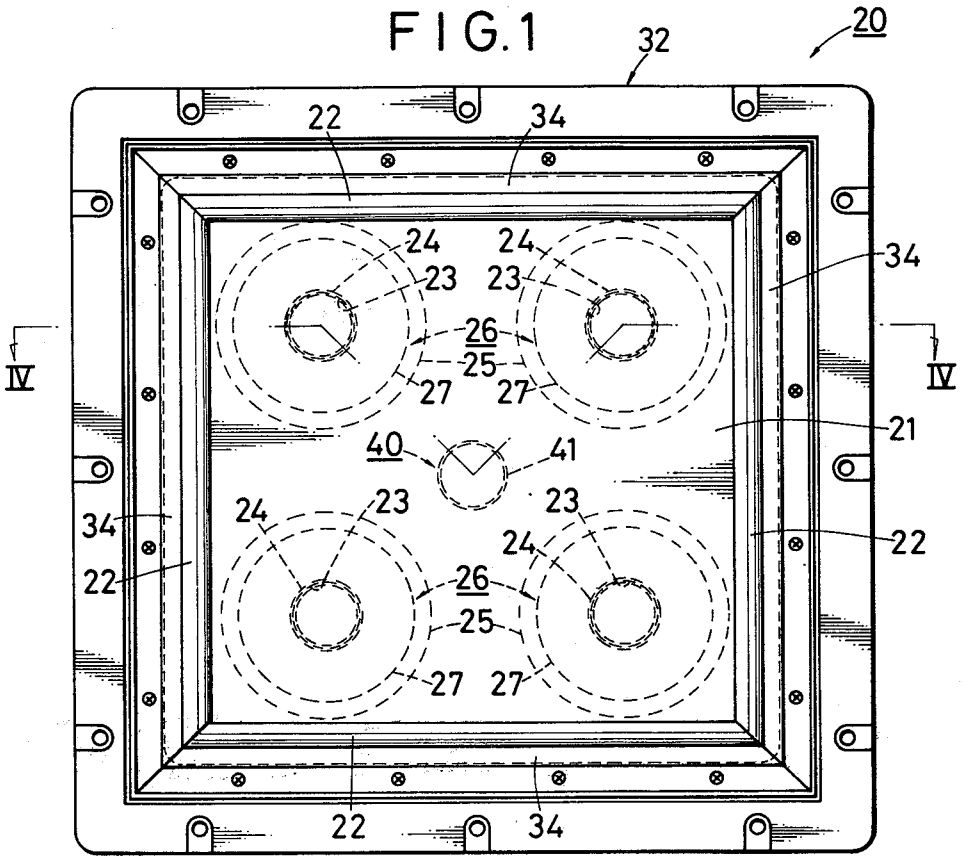
FIG. 1 is a front view of a loudspeaker according to a first embodiment of the invention.
Figure 2:
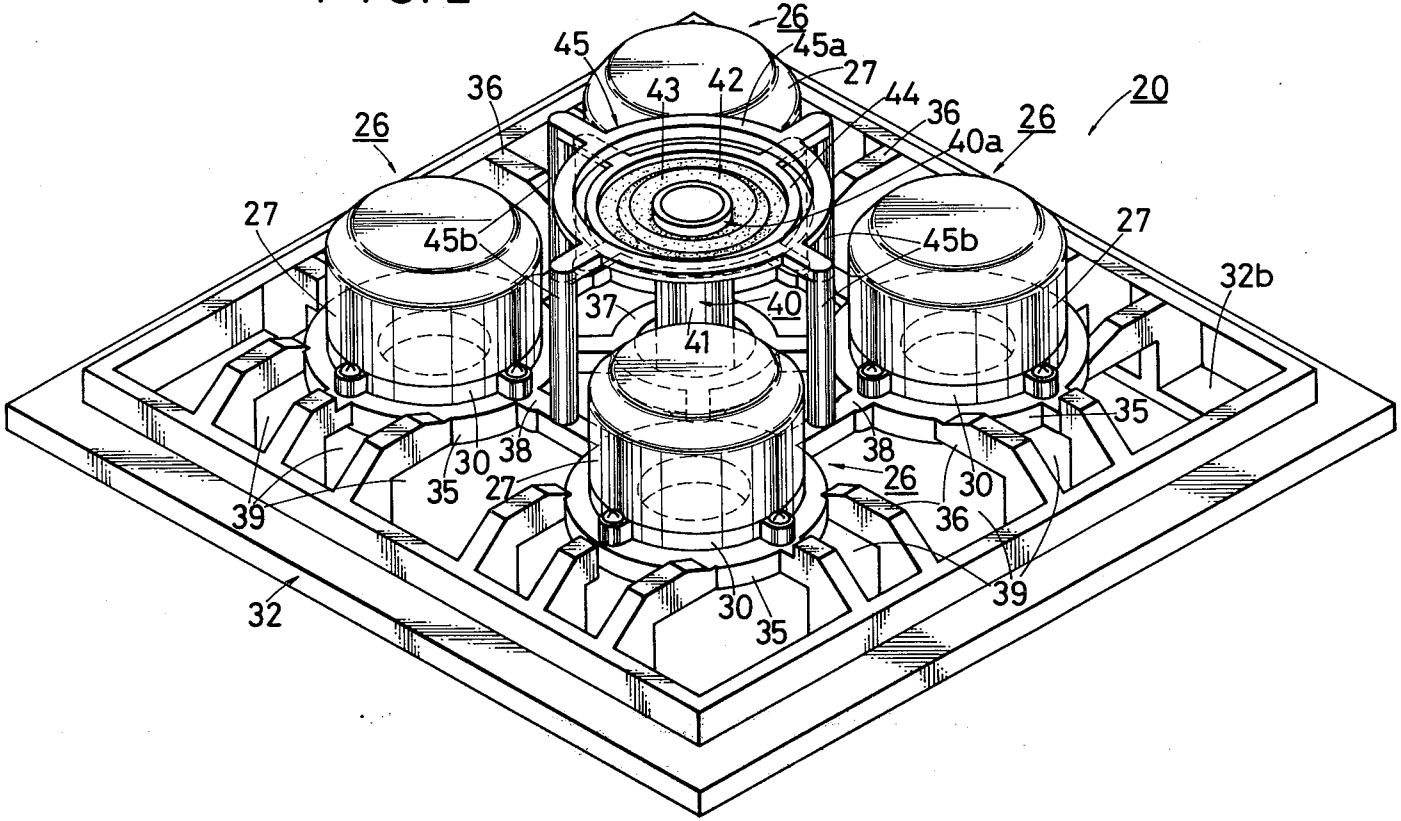
FIG. 2 is a rear perspective view of the loudspeaker shown in FIG. 1.
Figure 3:
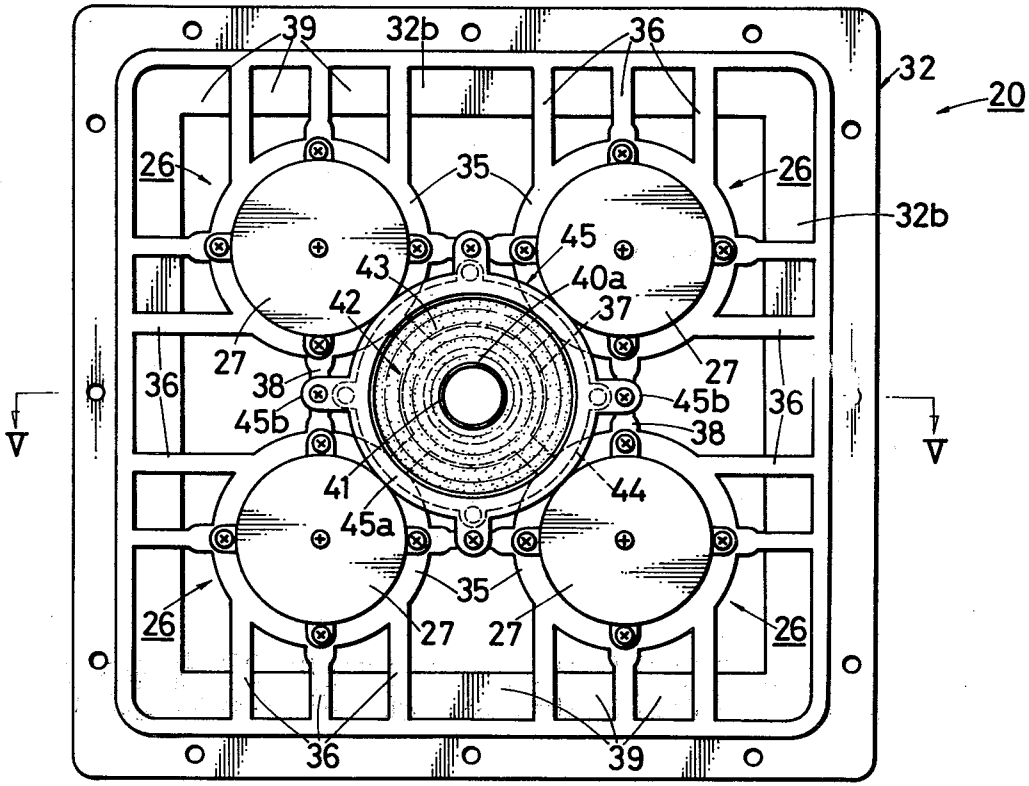
FIG. 3 is a rear view of the loudspeaker shown in FIG. 1.

Referring now to FIGS. 1 to 5, there is shown a loudspeaker 20 having a vibration unit which includes a square flat-plate diaphragm 21 attached at its margin to a square frame 32 by a resilient edge 22 and driven by four magnetic drivers or magnetic circuits 26. Each magnetic driver 26 is shown particularly on FIG. 4 to include a voice coil bobbin 23 attached to the rear surface of flat-plate diaphragm 21, a voice coil 24 wound on the periphery of voice coil bobbin 23 and a damper 25 connected between voice coil bobbin 23 and frame 32. The four voice coil bobbins 23 are connected to flat-plate diaphragm 21 at node portions of its divided vibration mode. This increases the frequency at which flat-plate diaphragm 21 enters divided vibration modes when the diaphragm is driven at these node portions.

Each magnetic driver 26 further includes a cup-shaped yoke 27 (FIGS. 2 and 4), a magnet 28 mounted against the bottom of cup-shaped yoke 27 within the latter, a center pole 29 attached to magnet 28, and a plate 30 mounted on the lip of cup-shaped yoke 27. A magnetic gap 31 is formed between center pole 29 and plate 30. The four magnetic drivers 26 are attached to a rear surface **32*b* of square frame 32 by any conventional means, such as, for example, screws which pass through plate 30 into square frame 32. Voice coils 24 are arranged in respective magnetic gaps 31. A marginal portion of each damper 25 is connected to a respective damper ring 33 which is attached to a front surace 32*a* of square frame 32 by conventional means, such as by screws. The marginal portion of resilient edge 22 is pinched between front surface 32*a* of frame 32 and a plurality of holding members 34, whereby resilient edge 22 is clamped to square frame 32. Accordingly, flat-plate diaphragm 21 may be driven in response to electric signals supplied to the plurality of voice coils 24**.

Square frame 32 may be made of any convenient material but is preferably of cast or pressed aluminum or zinc. Square frame 32 may be integrally formed with four mounting portions 35 (FIG. 2) for mounting the four magnetic drivers 26, a plurality of connecting beams 36 connecting mounting portions 35 to marginal portions of square frame 32, an annular rib 37 connecting mounting portions 35 to each other, and four beams 38 also connecting mounting portions 35 to each other. Thus, sufficient openings 39 are provided between mounting portions 35 and connecting beams 36, annular rib 37 and beams 38 to achieve an equivalent openness ratio at the rear of flat-plate diaphragm 21 as large as, for example, more than 60%.

The stiffness of square frame 32 is undesirably reduced when the openness ratio is large. Hence square frame 32 with its relatively heavy magnetic drivers 26 tends to resonate in rotation along lines a and b in FIG. 4 when flat-plate diaphragm 21 is driven. This degrades the frequency response of the loudspeaker. Since each damper 25 is so close to the rear of flat-plate diaphragm 21, it can exert very little leverage on flat-plate diaphragm 21 to prevent such rotational vibration. If it were possible to lengthen voice coil bobbin 23 to place damper 25 further away from flat-plate diaphragm 21, the increased leverage would reduce such rotational vibration. However, due to the limited strength of voice coil bobbin 23, the distance $l_1$ in FIG. 4 between the rear of flat-plate diaphragm 21 and damper 25 must be kept short.

In accordance with this invention, a connecting member or pole 40 is connected to the rear of flat-plate diaphragm 21 at, for example, a center $P_1$ perpendicular to the plane of flat-plate diaphragm 21 for preventing rotational vibration thereof. Pole 40 consists of a cylindrical or hollow bobbin 41, the length of which is substantially longer than the length of voice coil bobbin 23. Pole 40 passes through annular rib 37 in the center of square frame 32, and a free end **40*a* thereof is supported by a damping means 42 which includes a corrugated damper 43. The inner portion of corrugated damper 43 is attached to the periphery of hollow bobbin 41 and the outer portion thereof is attached to a ring 44. Ring 44 is attached to a supporting frame 45 which is, in turn, attached to square frame 32**.

Supporting frame 45 is made of any suitable material but is preferably cast, pressed or machined of aluminum or zinc. Supporting frame 45 includes an annular supporting portion **45*a* and four bracket arms 45*b*. The center of annular supporting portion 45*a* is aligned with axis $P_1$ of flat-plate diaphragm 21 (FIG. 4), and bracket arms 45*b* are connected to, for example, respective beams 38 of square frame 32 by any suitable means, such as by screws. Alternatively, supporting frame 45 may be integrally formed with square frame 32. The distance $l_2$ in FIG. 4 between free end 40*a* of pole 40 and flat-plate diaphragm 21 is substantially longer than the distance $l_1$ between dampers 25 associated with voice coil bobbins 23 and flat-plate diaphragm 21**.

Figure 4:
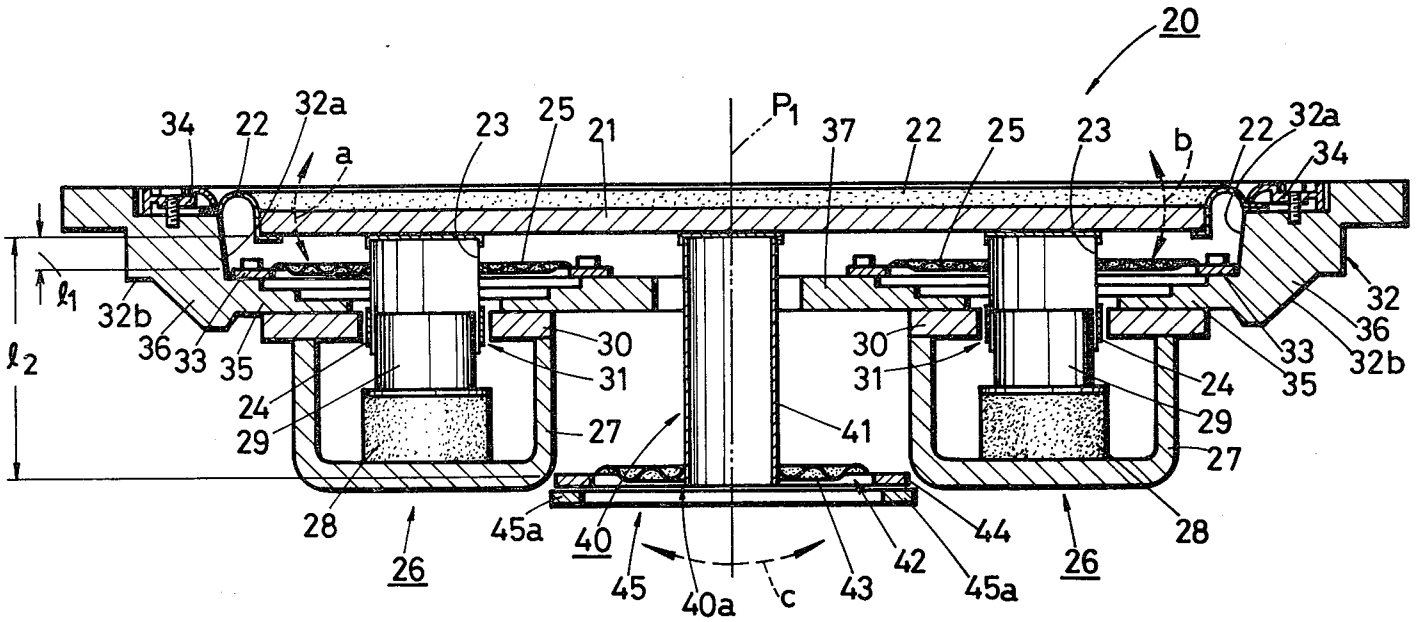
FIG. 4 is a cross sectional view taken along the line IV—IV in FIG. 1.
Figure 5:
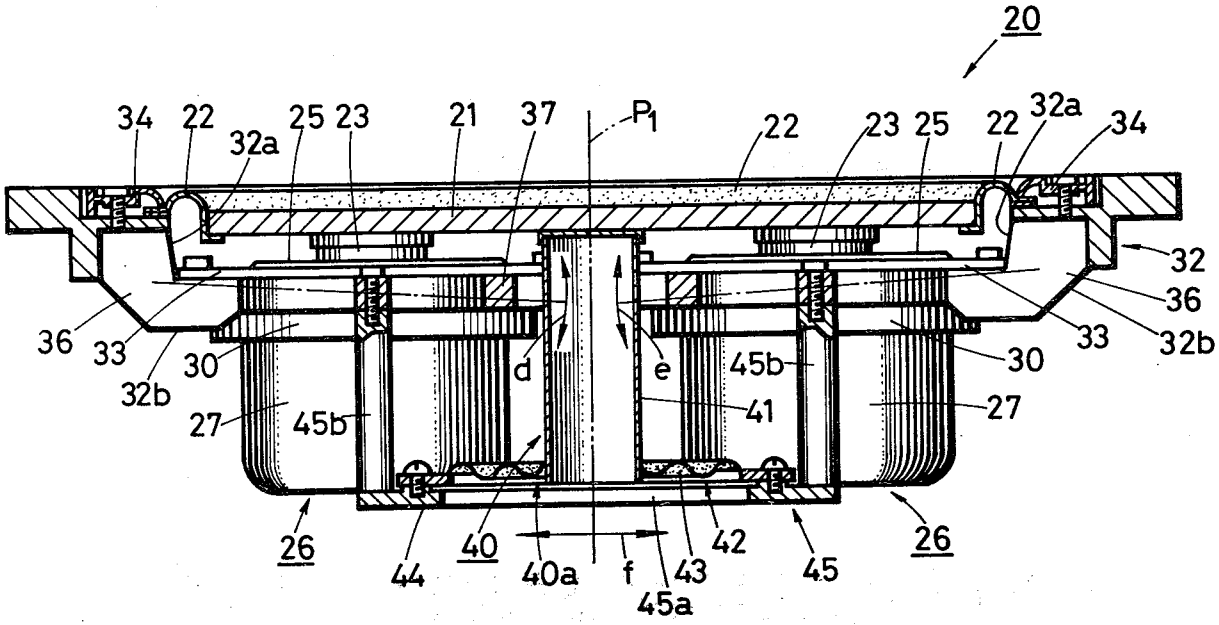
FIG. 5 is a cross-sectional view taken along the line V—V in FIG. 3.

Rotational vibration of flat-plate diaphragm 21 in the direction shown by arrows a and b in FIG. 4 is converted to vibration at the distal end of pole 40 in the direction shown by arrow c in FIG. 4. This vibration at the distal end of pole 40 is damped by corrugated damper 43 in damping means 42. Thus rotational vibration of flat-plate diaphragm 21 is reduced. The additional leverage afforded by the greater distance $l_2$ permits greater resistance to rotational vibration of flat-plate diaphragm 21 by damping means 42 than is possible by damper 25 acting through the shorter distance $l_1$.

Advantage is taken of supporting frame 45 to stiffen and reinforce square frame 32. Square frame 32 tends to vibrate in the directions shown by arrows d and e in FIG. 5, wherein the relatively rigid marginal portion of square frame 32 remains substantially fixed, and the less rigid interior of square frame 32 tends to vibrate. The vibration exhibits a maximum amplitude near the axis $P_1$ of loudspeaker 20. The vibration of square frame 32 in the direction of arrows d and e is converted to longitudinal expansion and contraction of annular supporting portion **45*a* of supporting frame 45 in the direction of arrow f. Therefore, vibration or resonance of square frame 32 is resisted by supporting frame 45. Annular rib 37 in the center of square frame 32** also serves to reduce vibration thereof.

Figure 6:
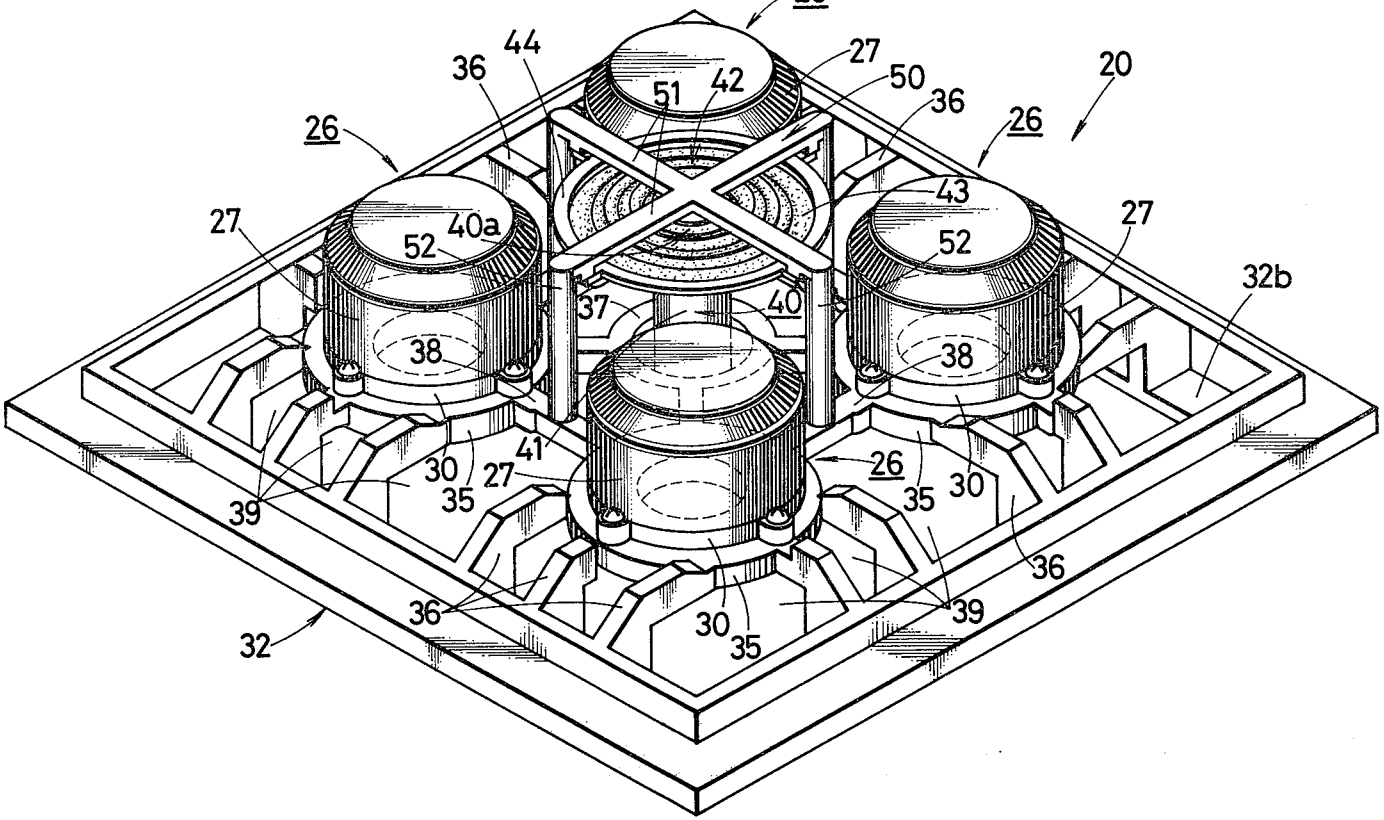
FIG. 6 is a rear perspective view of a loudspeaker according to a second embodiment of the invention.

FIG. 6 shows a loudspeaker 20 according to a second embodiment of this invention. Damping means 42 in loudspeaker 20 includes a supporting frame 50 having a crossbar-shaped beam 51 and four pillar portions 52. Supporting frame 50 may be attached to, or alternatively formed integrally with, square frame 32. Damper ring 44 is fixed on or attached to cross bar shaped beam 51. Cross bar shaped beam 51 provides additional stiffness along the arms thereof to resist longitudinal vibration in these directions.

Figure 7:
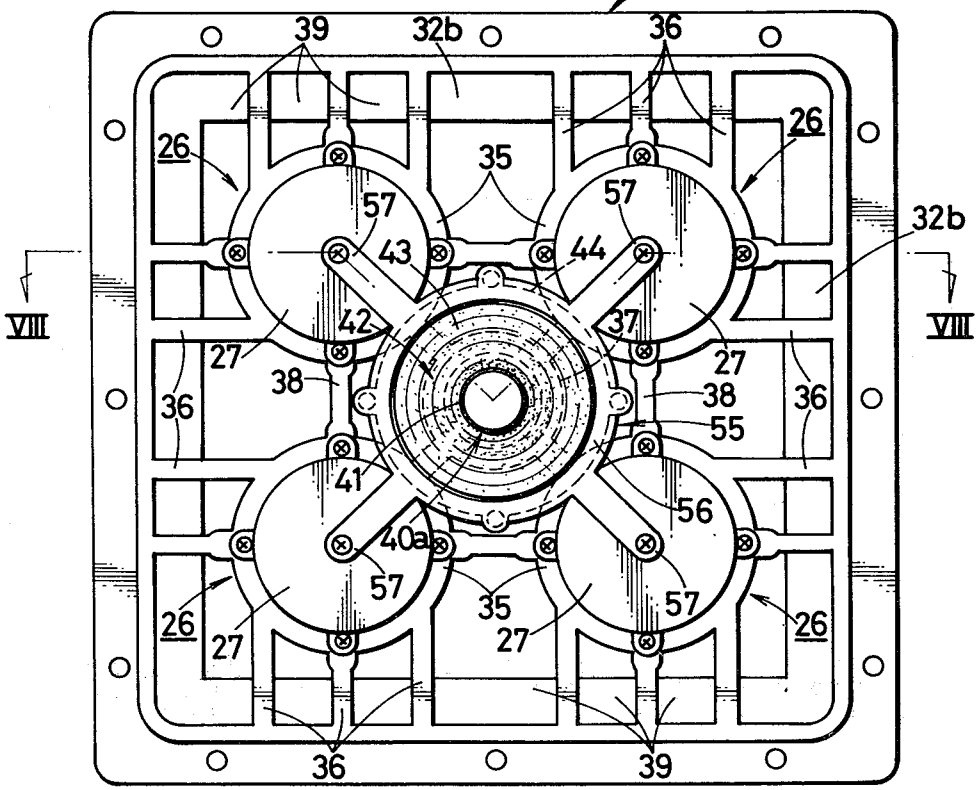
FIG. 7 is a rear view of a loudspeaker according to a third embodiment of the invention.
Figure 8:
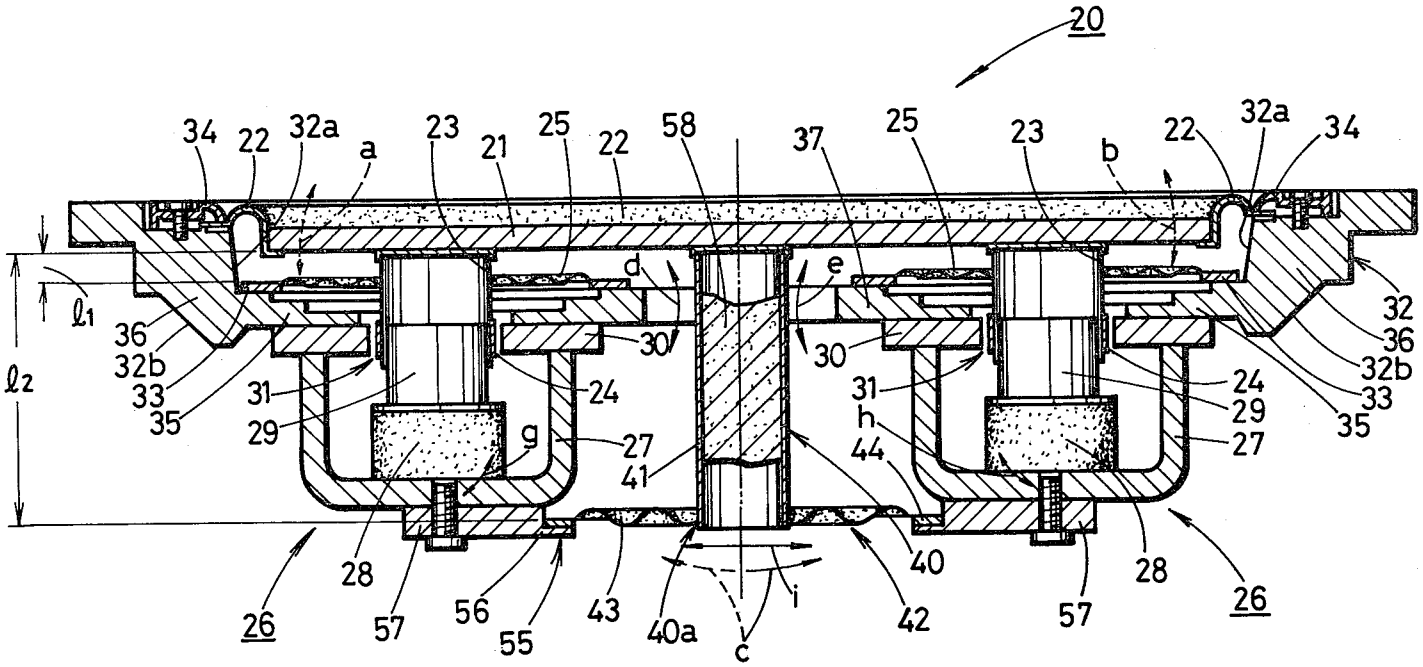
FIG. 8 is a cross-sectional view taken along the line VIII—VIII in FIg. 7.

FIG. 7 and FIG. 8 show a loudspeaker 20 according to a third embodiment of this invention. A supporting frame 55 includes an annular supporting portion 56 and four supporting arms 57 extending radially from annular supporting portion 56. Ring 44 is attached to annular supporting portion 56 and ends of supporting arms 57 are connected to cup-shaped yokes 27 by any convenient means such as by screws. Cup-shaped yokes 27 of magnetic drivers 26 tend to vibrate in the directions shown by arrows g and h in FIG. 8 when square frame 32 vibrates in the directions shown by arrows d and e. The amplitude of vibration of cup-shaped yokes 27 is larger than that of square frame 32 and has its largest amplitude at the distal ends thereof. Since the distal ends of cup-shaped yokes 27 are connected together by supporting frame 55, vibrations in the directions shown by arrows g and h are converted into longitudinal expansion and contraction of supporting frame 55 in the direction shown by arrow i. Therefore, vibration or resonance of square frame 32 is further reduced.

Hollow bobbin 41 may optionally be filled with sound-absorbing material 58 (FIG. 8). Sound-absorbing material 58 prevents resonance in the air column inside hollow bobbin 41 and prevents the generation of so called speaker noise. This further improves the audio characteristics of loudspeaker 20.

Figure 9:
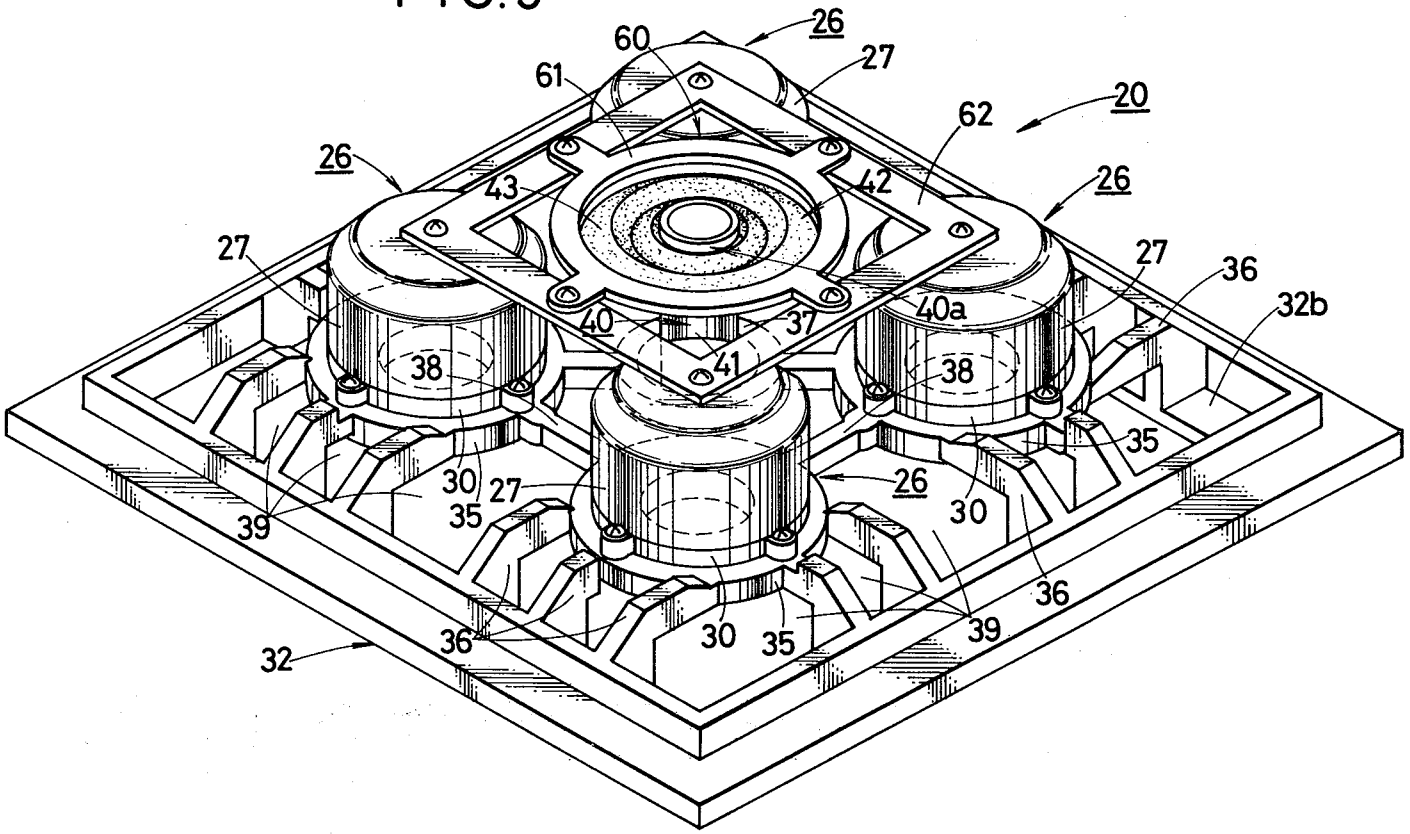
FIG. 9 is a rear perspective view of a loudspeaker according to a fourth embodiment of the invention.
Figure 10:
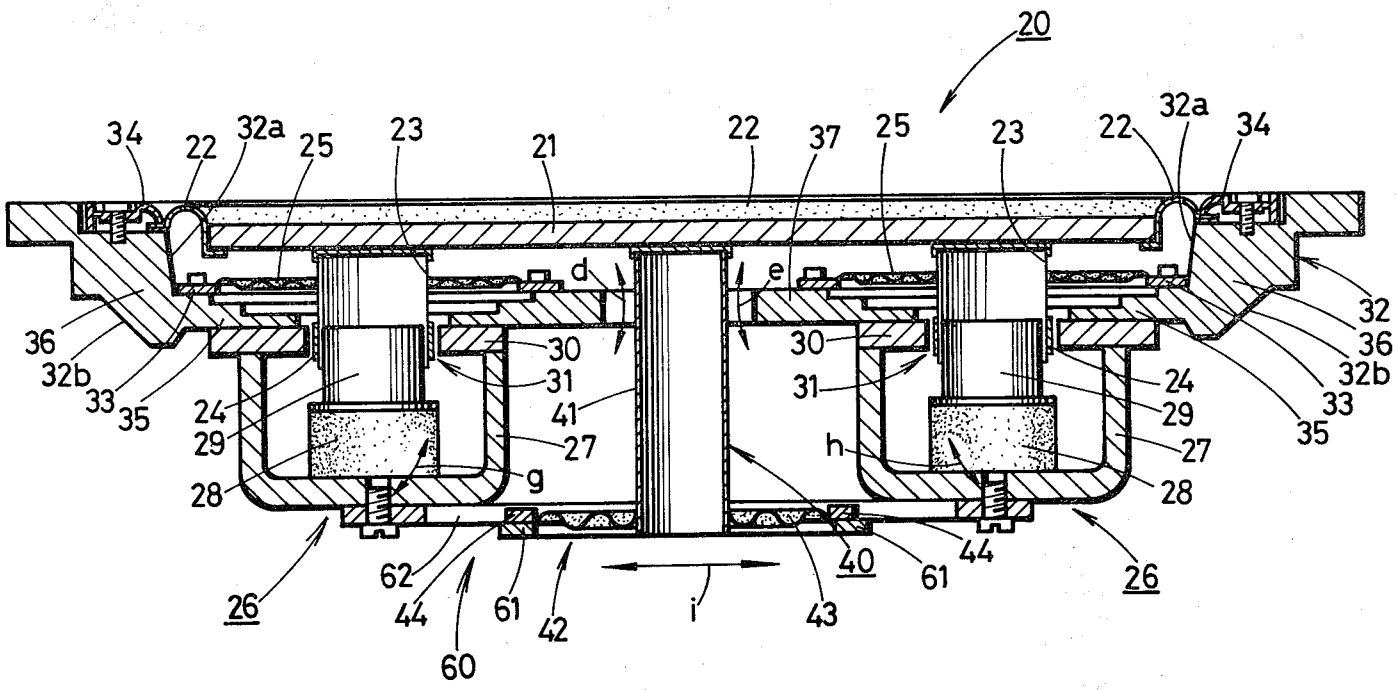
FIG. 10 is a cross-sectional view of the loudspeaker shown in FIG. 9 taken along a line corresponding to IV—IV in FIG. 1.

FIG. 9 and FIG. 10 show a loudspeaker according to a fourth embodiment of this invention. Damping means 42 of loudspeaker 20 has a supporting frame 60 having an annular supporting portion 61 inside a square frame structure 62. The four corners of square frame structure 62 are attached to respective centers of the distal ends of cup-shaped yokes 27 of magnetic drivers 26 and annular supporting portion 61 is attached to the centers of the sides of square frame structure 62. The sides of square frame structure 62 provide rigidity between adjacent cup-shaped yokes 27 and annular supporting portion 61 further braces square frame structure 62.

Figure 11:
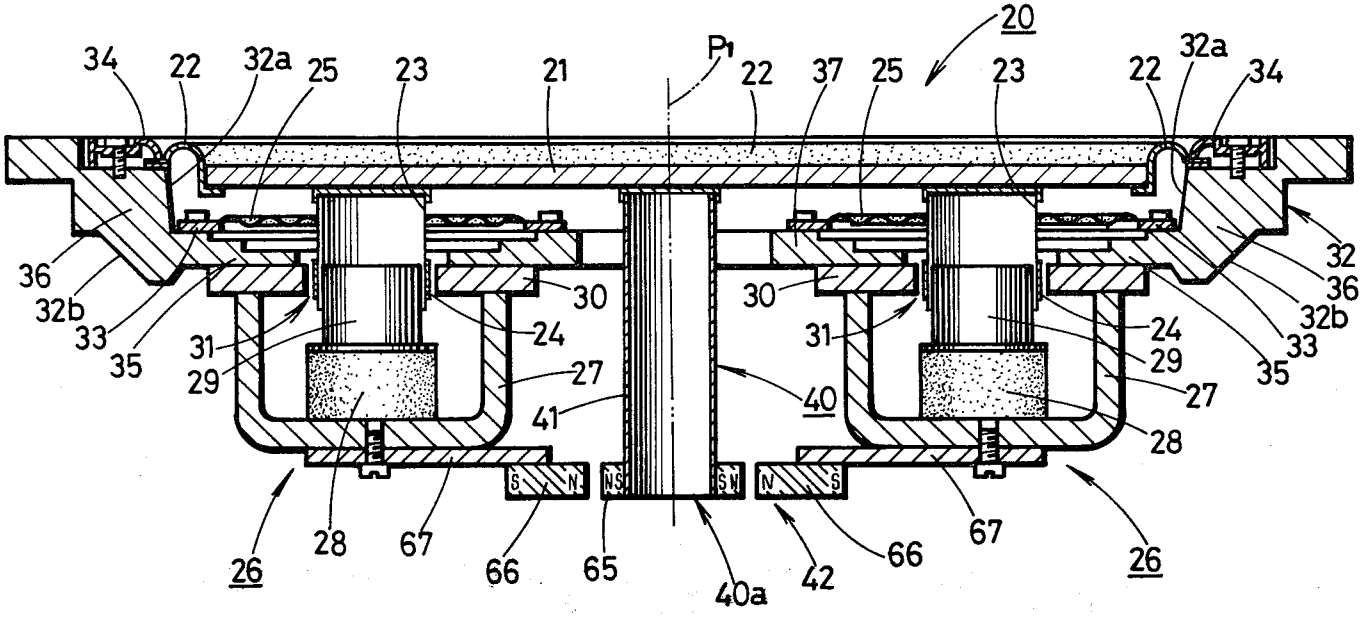
FIG. 11 is a cross-sectional view of a loudspeaker according to a fifth embodiment of the invention taken along a line corresponding to IV—IV in FIG. 1.

FIG. 11 shows a loudspeaker 20 according to a fifth embodiment of this invention. Damping means 42 of loudspeaker 20 includes an outer magnet ring 66 coaxial with an inner magnet ring 65. Inner magnet ring 65 is attached at the free end of pole 40 and outer magnet ring 66 is attached to a supporting frame 67 which may be mounted in any of the ways previously described such as, for example, on cup-shaped yokes 27 of magnetic drivers 26 or alternatively on square frame 32. Magnet rings 65 and 66 are magnetized as shown such that like magnetic poles face each other and thus cooperate in mutual repulsion to hold the free end of pole 40 aligned with the center $P_1$ of flat-plate diaphragm 21.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

For example, the construction and shapes of pole 40, damping means 42 and supporting frame 45, 50, 55, 60 or 67 are not limited to those described in the embodiments, and various changes and modifications may be made therein without departing from the spirit and scope of the invention.

Further, pole 40 may be connected elsewhere than at center $P_1$ of flat-plate diaphragm 21. In addition, a plurality of poles 40 and damping means 42 may be arranged to connect to a plurality of points of flat-plate diaphragm 21 wthout departing from the spirit and scope of the invention.

What is claimed is:

1. A flat-plate loudspeaker comprising:
a frame;
a diaphragm;
means for resiliently mounting said diaphragm in said frame;
drive means mounted on said frame for driving said diaphragm at a plurality of points thereon;
a pole connected to said diaphragm;
means for damping movement of said pole; and
supporting means connected to at least one of said frame and said drive means for supporting said means for damping.

2. A loudspeaker according to claim 1, wherein said points are disposed substantially at node portions of divided vibration modes of said diaphragm.

3. A loudspeaker according to claim 1, wherein said pole includes a cylindrical tube.

4. A loudspeaker according to claim 3, wherein said pole further includes sound absorbing means inside said cylindrical tube.

5. A loudspeaker according to claim 1, wherein said means for damping is connected between a free end of said pole and said supporting means.

6. A loudspeaker according to claim 5, wherein said means for damping includes a corrugated damper having an inside edge connected to said pole and an outside edge connected to said supporting means.

7. A loudspeaker according to claim 5, wherein said means for damping includes first and second magnetic members, said first magnetic member being connected to said pole and said second magnetic member being connected to said supporting means.

8. A loudspeaker according to claim 1, wherein said supporting means includes a support portion and at least one attaching portion, said support portion supporting said means for damping and said at least one attaching portion being connected to at least one of said drive means and said frame.

9. A Loudspeaker according to claim 8, wherein said supporting means is integrally formed with said frame.

10. A loudspeaker according to claim 8, wherein said support portion includes a ring.

11. A loudspeaker according to claim 8, wherein said support portion includes a crossbar-shaped portion.

12. A loudspeaker according to claim 8, wherein said at least one attaching portion includes a plurality of arm members connected to said frame.

13. A loudspeaker according to claim 8, wherein said at least one attaching portion includes arm members extended outward from said support portion and connected to said drive means.

14. A loudspeaker according to claim 8, wherein said at least one attaching portion includes a frame structure having a plurality of corners, said plurality of corners being connected to said drive means.

15. A loudspeaker according to claim 1, wherein said pole is connected to a center of said diaphragm.

16. A loudspeaker according to claim 1, wherein said drive means includes a plurality of magnetic drivers, each of said magnetic drivers having a magnetic gap, a voice coil bobbin and a voice coil in said magnetic gap wound around said voice coil bobbin, each said voice coil bobbin being connected to a respective one of said plurality of points on said diaphragm, and said pole being longer than said voice coil bobbin.

17. A loudspeaker according to claim 1; wherein said plurality of points surround a connection between said pole and said diaphragm.

* * * * *